US007929812B2

(12) United States Patent
Vannuffelen et al.

(10) Patent No.: US 7,929,812 B2
(45) Date of Patent: Apr. 19, 2011

(54) METHODS AND APPARATUS FOR SINGLE FIBER OPTICAL TELEMETRY

(75) Inventors: Stephane Vannuffelen, Meudon (FR); Tsutomu Yamate, Yokohama (JP); Bruno Gayral, Grenoble (FR); Soon Seong Chee, Kokubunji (JP); Colin Wilson, Surrey (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/416,930

(22) Filed: Apr. 2, 2009

(65) Prior Publication Data

US 2009/0224936 A1 Sep. 10, 2009

Related U.S. Application Data

(63) Continuation of application No. 11/017,264, filed on Dec. 20, 2004, now Pat. No. 7,515,774.

(51) Int. Cl.

| | |
|---|---|
| ***G02F 1/01*** | (2006.01) |
| ***G02F 1/035*** | (2006.01) |
| ***G01V 3/00*** | (2006.01) |

(52) U.S. Cl. ..... 385/1; 385/2; 340/854.7

(58) Field of Classification Search ..... 385/1, 2; 340/854.7

See application file for complete search history.

(56) References Cited

U.S. PATENT DOCUMENTS

| | | | | |
|---|---|---|---|---|
| 4,389,645 | A * | 6/1983 | Wharton | 340/854.7 |
| 4,547,774 | A | 10/1985 | Gould | |
| 5,675,674 | A * | 10/1997 | Weis | 385/12 |
| 5,889,607 | A | 3/1999 | Suzuki et al. | |
| 5,956,171 | A | 9/1999 | Denis et al. | |
| 6,137,621 | A | 10/2000 | Wu et al. | |
| 6,269,198 | B1 | 7/2001 | Hodgson et al. | |
| 6,400,490 | B1 | 6/2002 | Hosoi | |
| 6,437,326 | B1 | 8/2002 | Yamate et al. | |
| 6,535,320 | B1 | 3/2003 | Burns | |
| 6,738,174 | B1 | 5/2004 | Hill et al. | |
| 6,862,130 | B2 | 3/2005 | Batchko et al. | |
| 7,034,775 | B2 | 4/2006 | Kitamura et al. | |
| 7,187,620 | B2 | 3/2007 | Nutt et al. | |

FOREIGN PATENT DOCUMENTS

| | | |
|---|---|---|
| GB | 2104752 | 3/1983 |
| JP | 9715545 | 1/1997 |
| WO | 9616350 | 5/1996 |

OTHER PUBLICATIONS

R. Stephen Weis and Bras M. Beadle, "MWD Telemetry System for Coiled-Tubing Drilling Using Optical Fiber Grating Modulators Downholes", Proceedings of OFS-12, pp. 416-423, 1997.

A. Dandridge and C. Kirkendall, "Passive Fiber Optic Sensor Networks", pp. 433-449, John Wiley & Sons. Ltd.

Brochure of "Optical Fiber Strain Analyzer AQ8603", Ando Corporation.

* cited by examiner

*Primary Examiner* — Ryan Lepisto
*Assistant Examiner* — Jerry Blevins
(74) *Attorney, Agent, or Firm* — Daryl Wright; Jody DeStefanis; Jeff Griffin

(57) ABSTRACT

Single fiber optical telemetry systems and methods are disclosed. The methods and systems facilitate input and output via a single fiber optic interface. The optical telemetry systems and methods also facilitate faster data transmission rates between surface and downhole equipment in oilfield applications.

11 Claims, 13 Drawing Sheets

METHODS AND APPARATUS FOR SINGLE FIBER OPTICAL TELEMETRY

RELATED DATA INFORMATION

This application is a continuation application of co-pending U.S. patent application Ser. No. 11/017,264, filed Dec. 20, 2004, the content of which is incorporated herein by reference for all purposes.

FIELD OF THE INVENTION

The present invention relates generally to methods and apparatus for modulating and light. More particularly, the present invention relates to methods and apparatus for single fiber optical telemetry that may be useful to facilitate communication between various downhole tools traversing a subsurface formation and a surface data acquisition unit.

BACKGROUND OF THE INVENTION

Logging boreholes has been done for many years to enhance recovery of oil and gas deposits. In the logging of boreholes, one method of making measurements underground includes attaching one or more tools to a wireline connected to a surface system. The tools are then lowered into a borehole by the wireline and drawn back to the surface ("logged") through the borehole while taking measurements. The wireline is usually an electrical conducting cable with limited data transmission capability.

Demands for higher data transmission rates for wireline logging tools is growing rapidly because of the higher resolution, faster logging speed, and additional tools available for a single wireline string. Although current electronic telemetry systems have evolved, increasing the data transmission rates from about 500 kbps (kilobit per second) to 2 Mbps (Mega bits per second) over the last decade, data transmission rates for electronic telemetry systems are lagging behind the capabilities of the higher resolution logging tools. In fact, for some combinations of acoustic/imagining tools used with traditional logging tools, the desired data transmission rate is more than 4 Mbps.

One technology that has been investigated for increased data transmission rates is optical communication. Optical transmission rates can be significantly higher than electronic transmission rates. However, the application of optical fibers to the rigors of an oilfield environment have proved to be a significant hurdle. Compounding the problem of using optical fiber in an oilfield environment is the typical need for multiple fibers for most communications applications. In prior oilfield optical applications, one or more optical fibers is used for downlink commands, and one or more additional fibers is used for uplink data. The use of multiple optical fibers increases chance of a failure of at least one of the fibers or a failure at connections to the fibers, especially in an oilfield environment. Therefore, there is a need for an single-fiber optical telemetry system.

SUMMARY OF THE INVENTION

The present invention addresses the above-described deficiencies and others. Specifically, the present invention provides for a method of communication between a surface location and at least one downhole tool using an electro-optical telemetry system. The method includes generating a light at the surface location; sending the light to a downhole tool via a single optical fiber; obtaining a measurement of a downhole parameter with a sensor disposed in the tool; converting an electrical signal corresponding to the measurement of the downhole parameter into an optical signal by modulating the light sent from the surface location with a downhole EO modulator; sending the modulated light to the surface location via the single optical fiber; and converting the modulated light into an electrical signal at the surface location with an uphole OE modulator.

Additional advantages and novel features of the invention will be set forth in the description which follows or may be learned by those skilled in the art through reading these materials or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Figure 1:
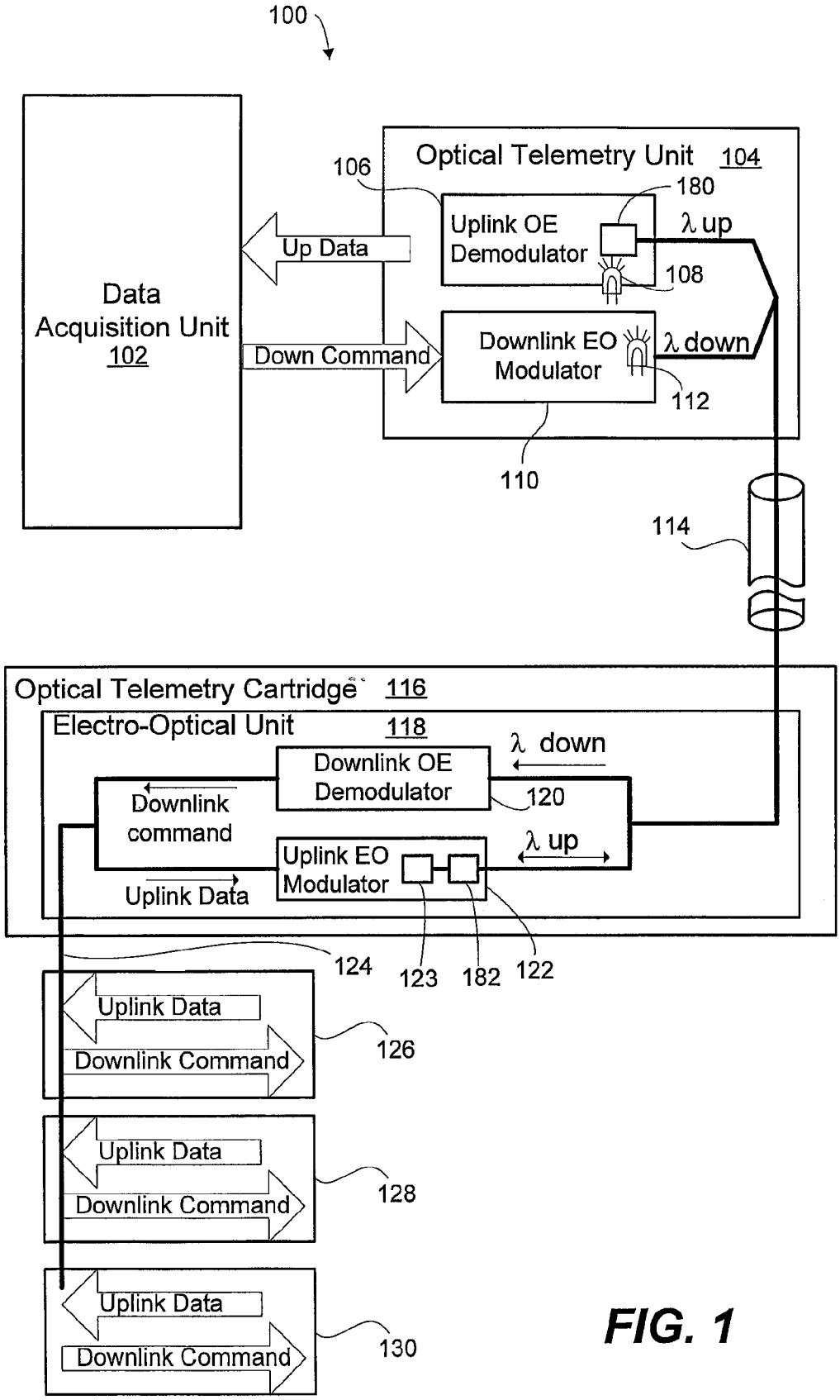
FIG. 1 is a schematic of downhole tools with an optical telemetry system having an inter-tool electrical tool bus and a single optical fiber according to one embodiment of the present invention.

Throughout the drawings, identical reference numbers and descriptions indicate similar, but not necessarily identical elements. While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION OF THE PREFERRED EMBODIMENTS

Illustrative embodiments and aspects of the invention are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

The present invention contemplates methods and apparatus facilitating optical communications between downhole tools and sensors, and surface systems. The use of fiber optics between downhole tools and the surface provides higher data transmission rates than previously available. The principles described herein facilitate active and passive fiber optic communications between downhole tools and sensors, and associated surface systems, even in high temperature environments. Some of the methods and apparatus described below describe a modified optical modulator that is particularly well suited to high temperature applications, but is not limited to high temperature environments.

As used throughout the specification and claims, the term "downhole" refers to a subterranean environment, particularly in a wellbore. "Downhole tool" is used broadly to mean any tool used in a subterranean environment including, but not limited to, a logging tool, an imaging tool, an acoustic tool, and a combination tool. A "hybrid" system refers to a combination of optical and electrical telemetry, and does not refer to an optical telemetry system and an electrical sensor. A "bus" is a communications interface electrically connecting a plurality of separate sensor packages or major components. For example, as contemplated herein, a "bus" may electrically connect a plurality of geophones, but the small connections between multiple components or sensors in a single geophone or other single package do not constitute a "bus." The words "including" and "having" shall have the same meaning as the word "comprising."

Turning now to the figures, and in particular to FIG. 1, a schematic of a downhole optical telemetry system (100) according to principles of the present invention is shown. The optical telemetry system (100) includes a surface data acquisition unit (102) in electrical communication with or as a part of a surface optical telemetry unit (104). The surface optical telemetry unit (104) includes an uplink optical-to-electrical (OE) demodulator (106) with an optical source (108). The optical source (108) is preferably a laser, a light-emitting diode (LED), white light source, or other optical source. The OE demodulator (106) preferably includes a photo detector or diode that receives optical uplink data sent at a first light wavelength (λ up) and converts it to electrical signals that can be collected by the data acquisition unit (102)

The surface optical telemetry unit (104) also includes a downlink electrical-to-optical (EO) modulator (110). An optical source (112) is shown with the downlink EO modulator (110). Alternatively, the optical source may be placed downhole in the borehole. The optical source (112) may operate at a second light wavelength (λ down) that is different from the first light wavelength (λ up). The EO modulator (110) may include any available EO modulator, or it may include components described below with reference to a modified lithium niobate modulator.

The uplink OE demodulator (106) and the downlink EO modulator (110) are operatively connected to a single-fiber fiber optic interface (114). The fiber optic interface (114) provides a high transmission-rate optical communication link between the surface optical telemetry unit (104) and a downhole optical telemetry cartridge (116). The downhole optical telemetry cartridge (116) is part of the optical telemetry system (100) and includes a downhole electro-optic unit (118). The downhole electro-optic unit (118) includes a downlink OE demodulator (120) and an uplink EO modulator (122). The downhole optical telemetry cartridge (116) is shown without any optical sources. The downlink OE demodulator (120) and the uplink EO modulator (122) are of the type that passively respond to optical sources. Alternatively, one or both of the downlink OE demodulator (120) and the uplink EO modulator (122) may include an optical source. The downlink OE demodulator (120) is preferably a photo detector similar or identical to the uplink OE demodulator (106).

The downhole electro-optic unit (118) is operatively connected to a downhole electrical tool bus (124). The downhole electrical tool bus (124) provides an electrical communication link between the downhole optical telemetry cartridge (116) and one or more downhole tools, for example the three downhole tools (126, 128, 130) shown. The downhole tools (126, 128, 130) may each have one or more sensors (not shown) for measuring certain parameters in a wellbore, and a transceiver for sending and receiving data. Accordingly, the downhole optical telemetry system is a hybrid optical-electrical apparatus that may use standard electrical telemetry and sensor technology downhole with the advantage of the high bandwidth fiber optic interface (114) between the downhole components (optical telemetry cartridge (116), downhole tools (126, etc.)) and the data acquisition unit (102).

Communications and data transfer between the data acquisition unit (102) and one of the downhole tools (126) is described below. An electronic Down Command from the data acquisition unit 102 is sent electrically to the surface optical telemetry unit (104). The downlink EO modulator (110) of the surface optical telemetry unit (104) modulates the electronic Down Command into an optical signal, which is transmitted via the fiber optic interface (114) to the downhole optical telemetry cartridge (116). Types of fiber optic interface (114) include wireline cables comprising a single optical fiber or multiple optical fibers. A single optical fiber may be facilitated by uniquely modified lithium niobate modulators discussed in more detail below with reference to FIGS. 2*a*-2*e*. The downlink OE demodulator (120) demodulates the optical signal back into an electronic signal, and the downhole optical telemetry cartridge (116) transmits the demodulated electronic signal along the downhole electrical tool bus (124) where it is received by the downhole tool (126). The demodulated electronic signal may be received by the other downhole tools (128, 130) as well.

Similarly, Uplink Data from the downhole tools (126, etc.) is transmitted uphole via the downhole electrical tool bus (124) to the downhole optical telemetry cartridge (116), where it is modulated by the uplink EO modulator (122) into an optical signal and is transmitted uphole via the fiber optic interface (114) to the surface optical telemetry unit (104). Sensors of the downhole tools (126, etc.) may provide analog signals. Therefore according to some aspects of the invention, an analog-to-digital converter may be included with each downhole tool (126, etc.) or anywhere between the downhole tools (126, etc.) and the uplink and downlink modulators/demodulators (118, 122). Consequently, analog signals from sensors are converted into digital signals, and the digital signals are modulated by the uplink EO modulator (122) to the surface. According to some embodiments, the optical source (108) is input via the optical fiber (114), modulated by the EO modulator (122), and output via the same optical fiber (114) back to the surface optical telemetry unit (104). The uplink OE demodulator (106) demodulates the signal back into an electronic signal, which is thereafter communicated to the data acquisition unit (102). As mentioned above, the downlink OE demodulator (120) and the uplink EO modulator (122) are passive and may only modulate optical sources from the surface, as the optical sources (108, 112) are located at the surface optical telemetry unit. Both uplink and downlink signals are preferably transmitted full-duplex using wavelength division multiplexing (WDM).

The uplink EO modulator (122) of the downhole electro-optical unit (118) preferably comprises an external lithium niobate modulator (123) shown in more detail with reference to various embodiments in FIGS. 2*a*-2*e*.

The lithium niobate modulator (123) may be an intensity modulator. Other materials that exhibit similar optical properties may also be used as an intensity EO modulator. For example, according to some aspects of the present invention, intensity modulators may comprise materials including, but not limited to: lithium tantalite, strontium barium niobate, gallium arsenide, and indium phosphate. Moreover, lithium niobate is not limited to intensity modulation. Lithium niobate may be used to make phase and polarization modulators as well according to some aspects of the invention.

However, lithium niobate intensity modulators have a polarization dependency, and therefore the polarization state of any input signal to lithium niobate modulators is preferably aligned. Therefore, according to the configuration of FIG. 1, the polarization of input light is randomized by a polarization scrambler (180) of the surface optical telemetry unit (104), and a polarizer (182) in front of the lithium niobate modulator (123) aligns the polarization state. Different wavelengths of uplink and downlink are selected, and the uplink and downlink signals are selected by the WDM technique. The polarizer (182) may comprise a dielectric thin film filter such as polacor, which is a near-infrared polarizing glass material. The polarizer (182) may be physically mounted between an output waveguide or optical path and the output fiber or interface (114), thus becoming integral with the waveguide of the uplink EO modulator (122).

Figure 2A:
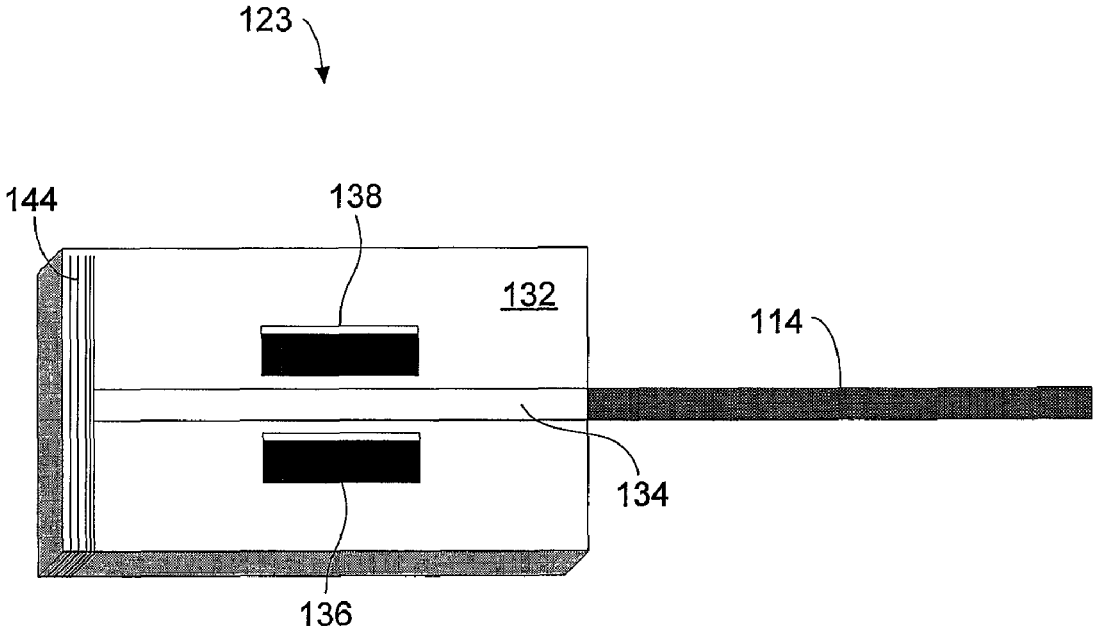
FIG. 2*a* is a perspective view of an optical modulator arranged according to one embodiment of the present invention.

The downlink EO modulator (110, FIG. 1) may be similar or identical to the uplink EO modulator (122), but this is not necessarily so. As shown in FIG. 2*a*, one embodiment of the lithium niobate modulator (123) is preferably a waveguide type phase modulator and therefore includes a lithium niobate substrate (132) with an optical path or waveguide (134) disposed therein. Operatively connected or coupled to the waveguide (134) is an optical input, which according to the embodiment of FIG. 2*a*, is the fiber optic interface (114). The fiber optic interface (114) carries a light beam that travels along the waveguide (134). About the waveguide (134) are first and second electrodes (136, 138). The first electrode (136) is grounded, and the second electrode (138) is driven by a voltage signal. As the voltage across the electrodes (136, 138) changes, a refractive index of the waveguide (134) changes, alternating the light beam passing through the waveguide (134) as the refractive index rises and falls. The alternating of the refractive index modulates the phase of the light, but the output intensity remains essentially unchanged.

However, typical lithium niobate modulators are prone to DC bias drift, especially when there are fluctuations in temperature. In a feedback-bias-controlled modulation operation, a certain DC voltage is applied to the AC-driven electrode (138) as a known initial DC bias. This applied DC voltage is varied continuously to keep the state of the optical output modulation at the initial state. However, the initial DC bias depends on the mechanical fluctuations caused by changes in temperature, and can result in a change of the optical characteristics between two optical paths. Downhole wellbore environments are well known to have high temperatures and high temperature fluctuations, which influence the refractive index of the waveguide (134) and must be maintained within a controlled range to allow reliable EO modulation.

Figure 2B:
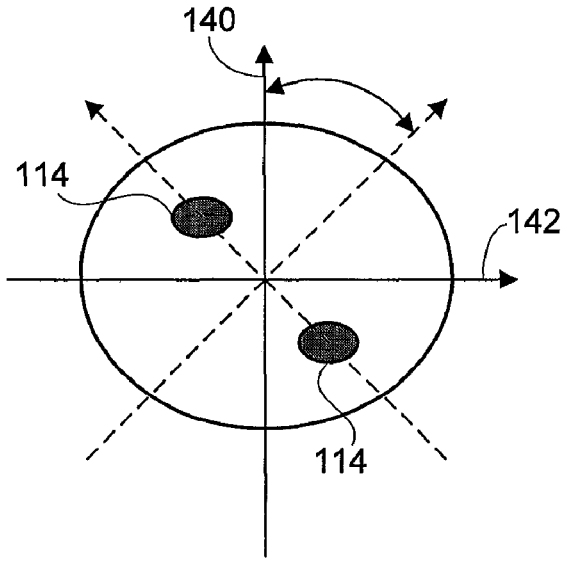
FIG. 2*b* is a schematic view of the angles related to the modulator of FIG. 2*a*.

Therefore, according to the embodiment of FIG. 2*b*, the fiber optic interface (114) is a polarization maintaining fiber that is rotated an odd multiple of approximately 45 degrees from the waveguide (134, FIG. 2*a*). The waveguide (134, FIG. 2*a*) has an X-axis (140) (ordinary refractive index, $n_o$) and a Z-axis (142) (extraordinary refractive index $n_e$). Therefore, according to one embodiment the fiber optic interface (114) is rotated an odd multiple of approximately 45 degrees with respect to the X and Z axes (140, 142) as shown. By setting the polarization maintaining fiber (the fiber optic interface (114)) at 45-degree rotations (or an odd multiple thereof), phase modulation can be converted to intensity modulation.

Figure 2C:
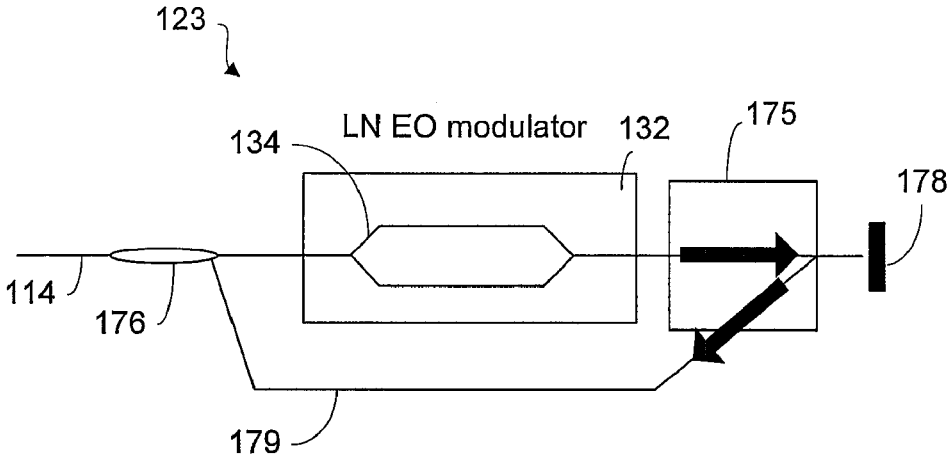
FIG. 2*c* is a schematic a lithium niobate electrical-to-optical modulator having an optical circulator and a reflector to enable a single input/output fiber according to one embodiment of the present invention.
Figure 2D:
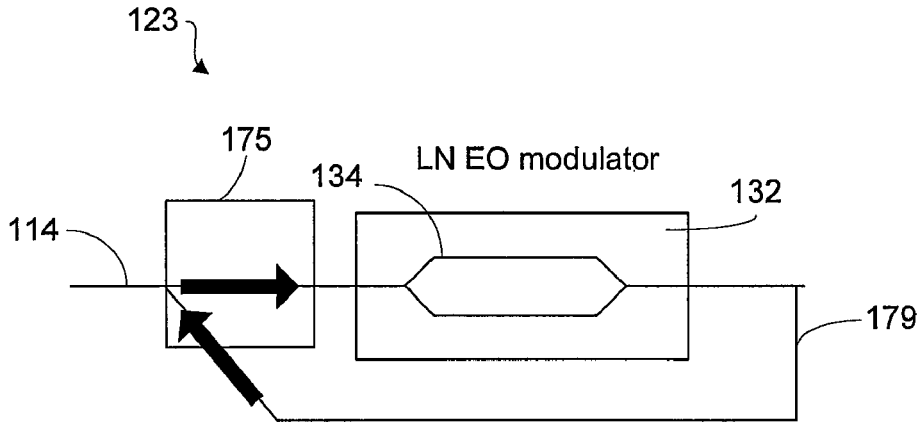
FIG. 2*d* is a schematic of a lithium niobate electrical-to-optical modulator having an optical circulator to enable a single input/output fiber according to another embodiment of the present invention.
Figure 2E:
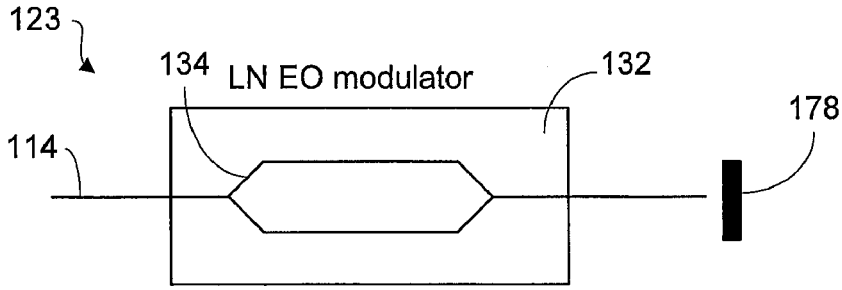
FIG. 2*e* is a schematic of a lithium niobate electrical-to-optical modulator having a reflector to enable a single input/output fiber according to another embodiment of the present invention.

The downhole optical telemetry system (100) of FIG. 1 may operate with the single fiber optic interface (114) shown. However, in order to operate with a single fiber, the lithium niobate modulator (123) may be specially designed in one of a number of ways to facilitate a single input/output fiber (114). For example, FIGS. 2*c*-2*e* illustrate three ways to create a single input-output fiber. FIGS. 2*c* and 2*d* illustrate the single fiber lithium niobate EO modulator (123) with an optical circulator (175). FIG. 2*c* illustrates the optical circulator (175) downstream of the lithium niobate substrate (132), with an upstream optical coupler (176). The single-fiber lithium niobate EO modulator (123) of FIG. 2*c* also includes a reflector (178). Thus, an input light source may enter through the input/output fiber (114), be modulated as it passes through the waveguide (134), and pass a modulated output signal through the optical circulator (175). The output signal is then reflected by the reflector (178), redirected through the optical circulator (175) to a bypass fiber (179), reconnected to the input/output fiber (114) by the optical coupler (176), and returned uphole via the input/output fiber (114).

FIG. 2*d* illustrates the single fiber lithium niobate EO modulator (123) without a reflector. According to FIG. 2*d*, an input light source may enter through the optical circulator (175) via the input/output line (114) and be modulated. The output signal is then redirected via the bypass fiber (179) back to the optical circulator (175), and returned uphole via the single input/output fiber interface (114).

In some cases, for example if the modulation frequency is less than approximately 100 Mbit/sec, the optical circulator (175) may be omitted as shown in FIG. 2*e* because the modulated light signal which is reflected by the reflector (178) can pass back through the lithium niobate substrate (132) without signal degradation.

The waveguide (134) may be created by molecular diffusion with a Ti or H substrate in the LiNbO3 substrate (132). If Ti is used, both $n_o$ and $n_e$ are increased and therefore, polarization in both the X-axis (140, FIG. 2*b*) direction and Z-axis (142, FIG. 2*b*) direction travel through the guide (134). A system of electrodes, rather than only the first and second electrodes (136, 138, FIG. 2*a*) may be deposited on the lithium niobate substrate (132) to more accurately generate an electrical field parallel to the Z-axis direction (142, FIG. 2*b*). The electric field parallel to the Z-axis (142, FIG. 2*b*) leads to a change of the refractive index $n_e$ in the Z-axis (142, FIG. 2*b*) direction while $n_o$ is unchanged. Therefore, if light arrives polarized with two components, electrical field components $E_x$ and $E_z$, a phase shift is generated between $E_x$ and $E_z$. This phase shift is approximately proportional to the electrical field generated by the electrodes. The light travels along the waveguide (134), and, after entering the modulator, may be reflected back by the reflector and then travel back to through the modulator as an output. Due to their travel through the modulator, $E_x$ and $E_z$ are phase shifted by an angel $\phi$. $\phi$ depends on the length of the modulator and on the voltage applied on the electrodes. $E_x$ and $E_z$ are then recombined in one single polarization by the polarizer (182, FIG. 1). Therefore, the light interferes with itself and the resulting intensity is given by:

$$I \approx \frac{I_0}{4}(1+\cos(\varphi))^2$$

where I=initial intensity and assuming that $E_x$ and $E_z$ are substantially equal Thus, an intensity modulation directly related to $\phi$ and therefore to the voltage applied on the electrodes is generated.

The paragraphs above describing the lithium niobate modulator (123) exemplify one of the two principal branches of light intensity modulation. The lithium niobate modulator (123) is an example of light intensity modulation using the first branch: electro-optic effect. The other principal branch of intensity modulation is termed the electro-absorption effect. The electro-absorption effect is based on the Stark effect in quantum well structure. Absorption properties can be characterized by absorption as a function of wavelength. It is well known that by applying a voltage to a waveguide, it is possible to modify the energy level and wave function inside the quantum well, leading to a change in the light absorption properties of the quantum well. In particular, it is possible to create a so-called red-shift of the quantum well absorption that is directly related to the electrical field applied to it. The red-shift leads to a shift of the absorption curve of the device toward higher wavelengths. Using this effect, a light beam may be modulated. Both electro-optic modulators and electro-absorption modulators use an optical path or waveguide. According to principles of the present invention, electro-optic or electro-absorption modulators may be used and coupled only to the single input/output fiber (114). According to some embodiments, the substrate of the electro-absorption modulators may comprise indium phosphide.

Figure 7:
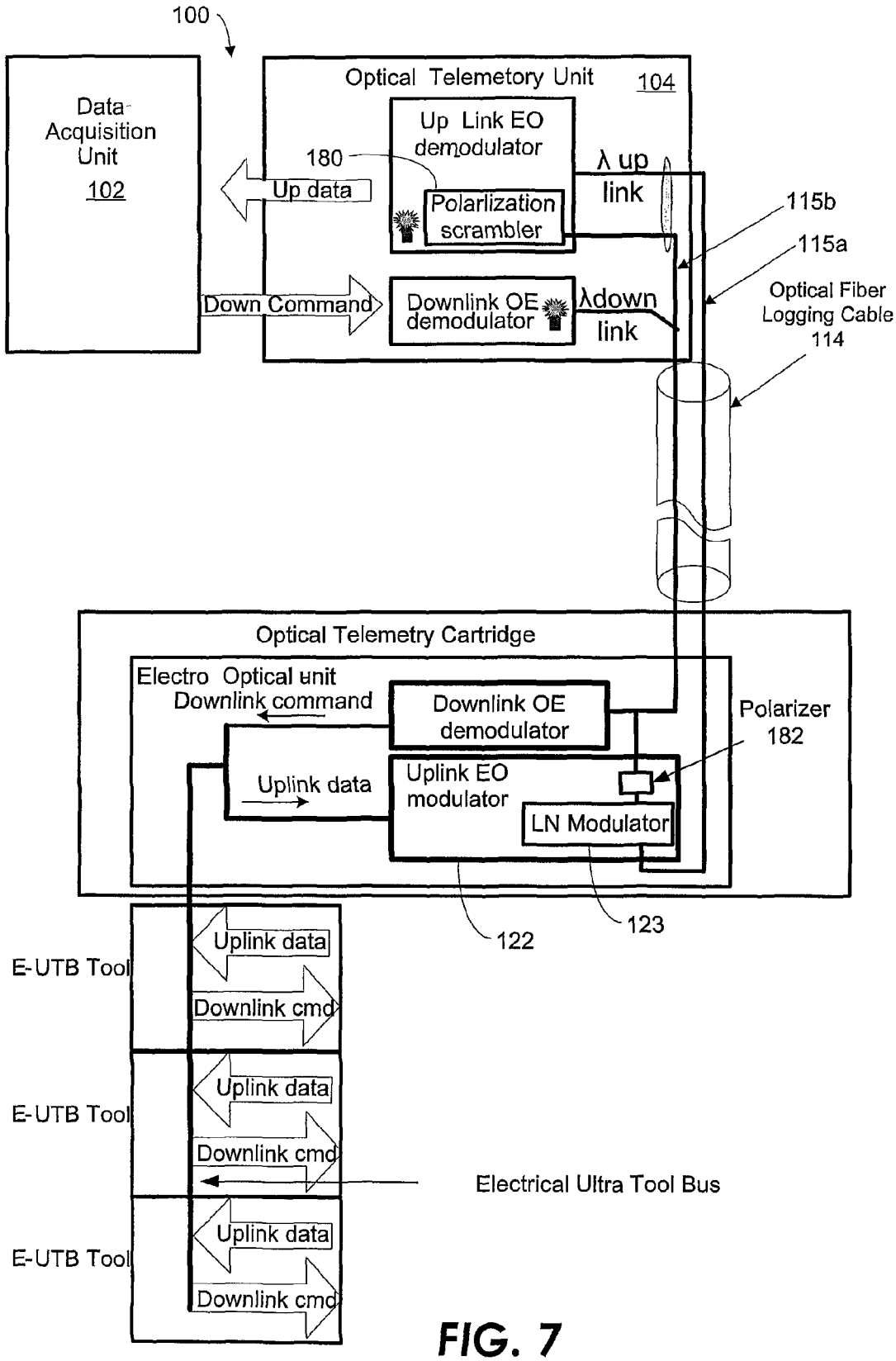
FIG. 7 is a schematic of a downhole tools with an optical telemetry system having an intertool electrical tool bus and multiple optical fibers according to one embodiment of the present invention.

Although FIG. 1 illustrates a single optical fiber system, multiple fiber systems are also contemplated by the present invention. FIG. 7 shows the optical fiber system (100) wherein the uplink EO modulator (122) comprises the lithium niobate modulator (123), and two fibers (115*a*, 115*b*) comprise the fiber optic interface (114). One fiber (115*a*) comprises an uplink interface, and the other fiber (115*b*) comprises a downlink interface and may also provide the light source for the uplink EO modulator (122).

Figure 3:
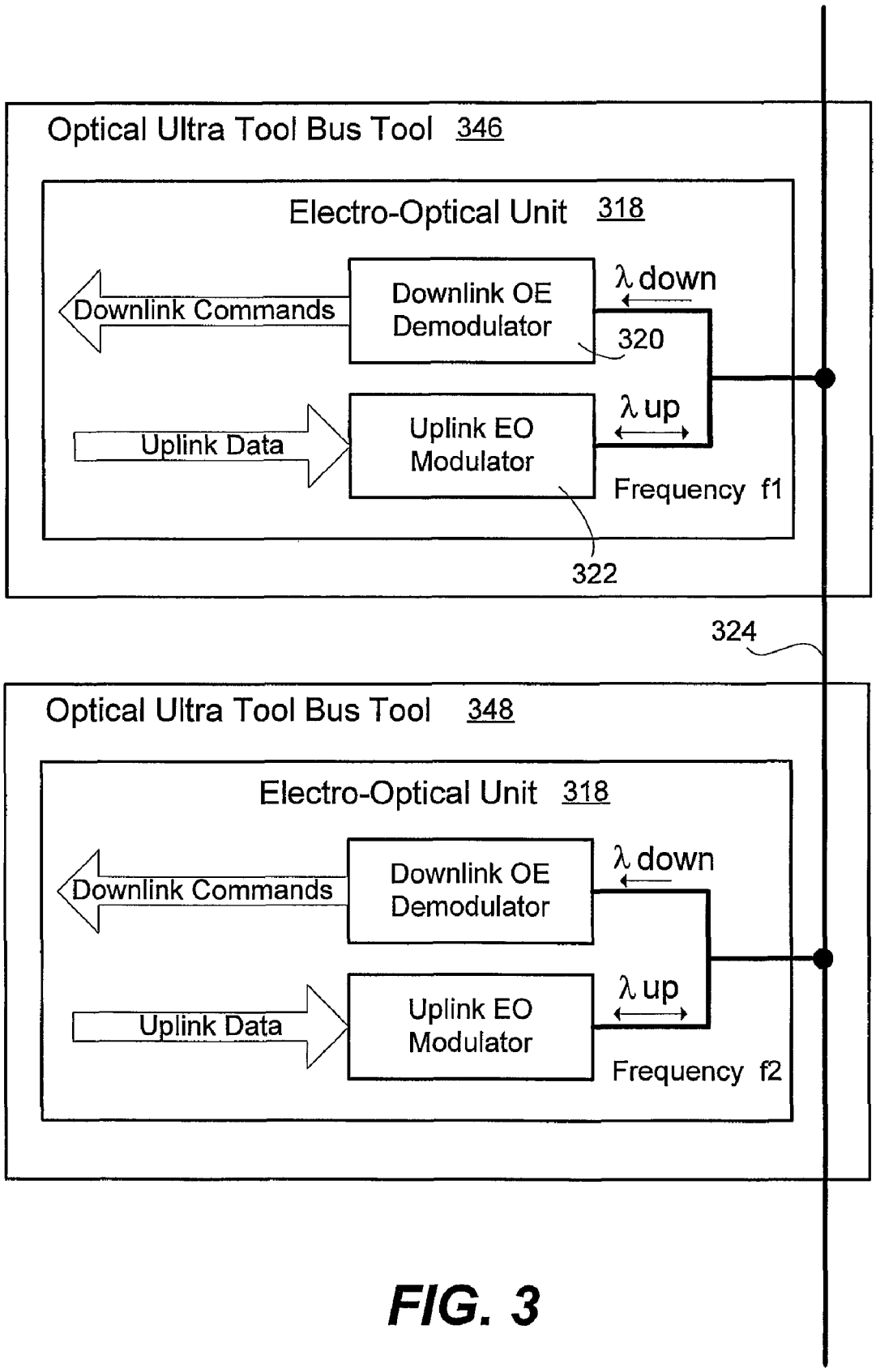
FIG. 3 is a schematic of a downhole tool with a fish-bone type optical telemetry system having an optical tool bus according to another embodiment of the present invention.

Referring next to FIG. 3, another embodiment of a downhole optical telemetry system is shown. The embodiment of FIG. 3 illustrates a downhole optical tool bus (324) as opposed to the downhole electrical tool bus (124) shown in FIG. 1. The downhole optical tool bus (324) comprises an extension of the fiber optic interface (114, FIG. 1) and is therefore in communication with the surface optical telemetry unit (104, FIG. 1). The downhole optical tool bus (324) is connected to one or more downhole tools, which according to FIG. 3 include a first optical tool bus tool (346) and a second optical tool bus tool (348). The first and second optical tool bus tools (346, 348) each include similar or identical electro-optical units (318). However, to distinguish between data from the first and second optical tool bus tools (346, 348), the electro-optical unit (318) of the first optical tool bus tool (346) operates at a first frequency (f1) and the electro-optical unit (318) of the second optical tool bus tool (348) operates at a second frequency (f2). Additional optical ultra bus tools may also be in communication with the downhole optical tool bus (324) and operate at other different frequencies.

The electro-optical units (318) are similar to the electro-optical unit (118, FIG. 1) described above, however, the electro-optical units (318) do not include connections to an electrical tool bus (124, FIG. 1). Accordingly, the electro-optical units (318) include a downlink OE demodulator (320) and an uplink EO modulator (322). As described above, the uplink EO modulator (322) of the downhole electro-optical unit (318) is preferably a lithium niobate modulator shown in more detail with reference to FIGS. 2*a*-2*e* above. Similarly, the downlink OE demodulator (320) is preferably a photo detector similar or identical to the uplink OE demodulator (106, FIG. 1).

Figure 4:
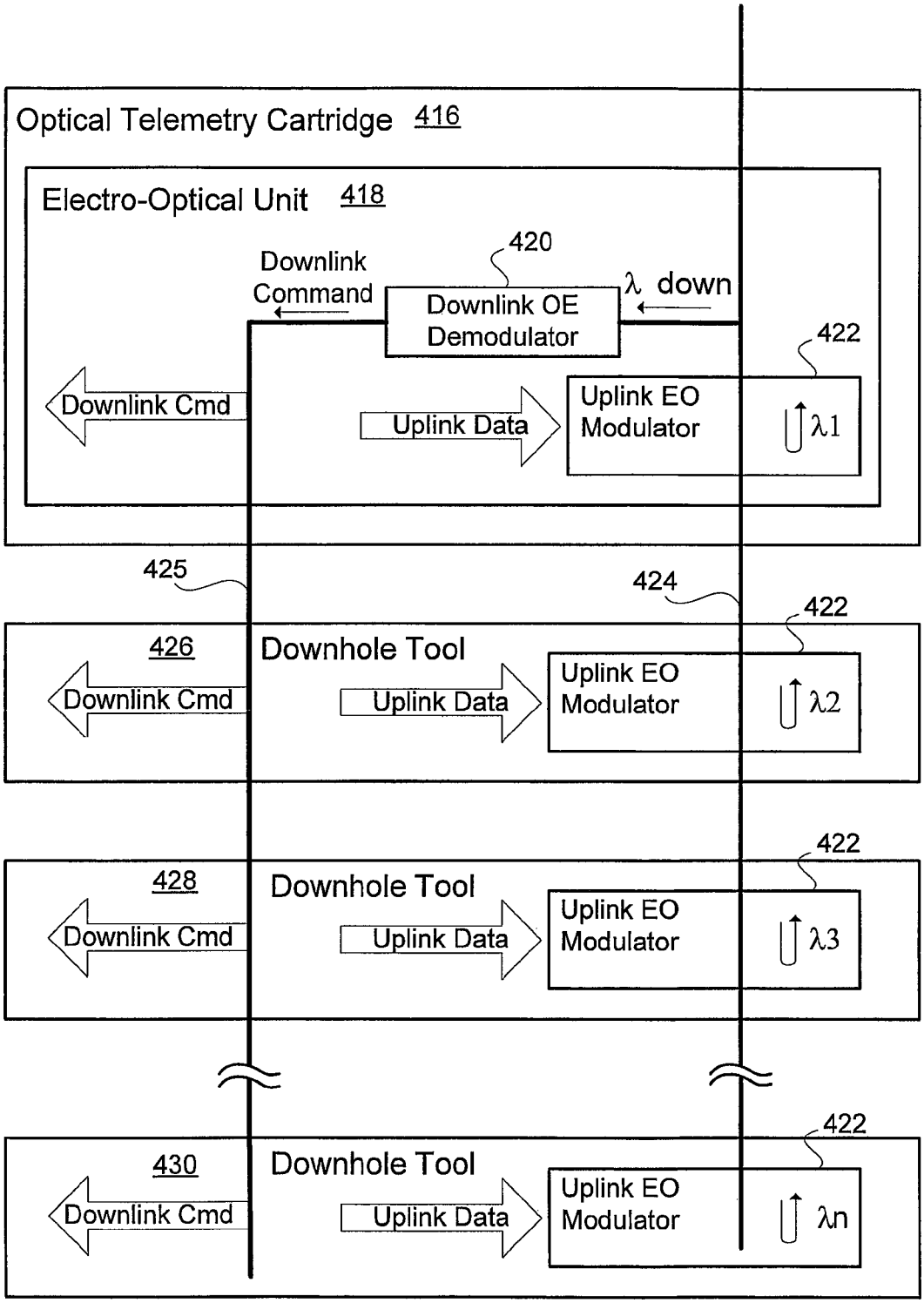
FIG. 4 is a schematic of a downhole tool with an in-line type optical telemetry system having an optical tool bus according to another embodiment of the present invention.

Referring next to FIG. 4, another embodiment of a downhole optical telemetry system is shown. The embodiment of FIG. 4 also illustrates a downhole optical tool bus (424) similar to the optical tool bus (324) of FIG. 3. The downhole optical tool bus (424) is in communication with the surface optical telemetry unit (104) as shown in FIG. 1. The embodiment of FIG. 4 also includes a downhole optical telemetry cartridge (416). The downhole optical telemetry cartridge (416) comprises an electro-optic unit (418). However, unlike the electro-optic unit (318) of FIG. 3, the electro-optical unit (418) of FIG. 4 includes an uplink electrical-to-optical modulator (422) and may optionally have an in-line reflective unit or wavelength separator such as a Bragg grating assigned to or allowing passage of a first wavelength ($\lambda$1) of light. The electro-optical unit (418) also includes a downlink optical-to-electrical demodulator (420) similar or identical to the downlink OE demodulator (120) of FIG. 1.

Further, the embodiment of FIG. 4 includes a downhole electrical tool bus (425). The downhole electrical tool bus (425) transmits downlink commands and provides inter-tool and/or intra-tool communication in a manner similar to that described in FIG. 1. However, unlike the embodiment of FIG. 1, uplink data is transmitted via the downhole optical tool bus (424) directly from the downhole tools (426, 428, 430) instead of first being modulated by the optical telemetry cartridge 416. Again, the downhole optical tool bus (424) comprises the fiber optic interface (114, FIG. 1) in this instance. Accordingly, the embodiment of FIG. 4 includes one or more downhole tools (426, 428, 430), each comprising an uplink electrical-to-optical modulator (422) and a mechanism such as a wavelength separator to distinguish between tool signals. The uplink electrical-to-optical modulators (422) are operatively connected to the optical tool bus (424), thus uplink data from sensors in the downhole tools (426, 428, 430) is modulated at each tool and transmitted directly to the downhole optical tool bus (424).

Figure 5:
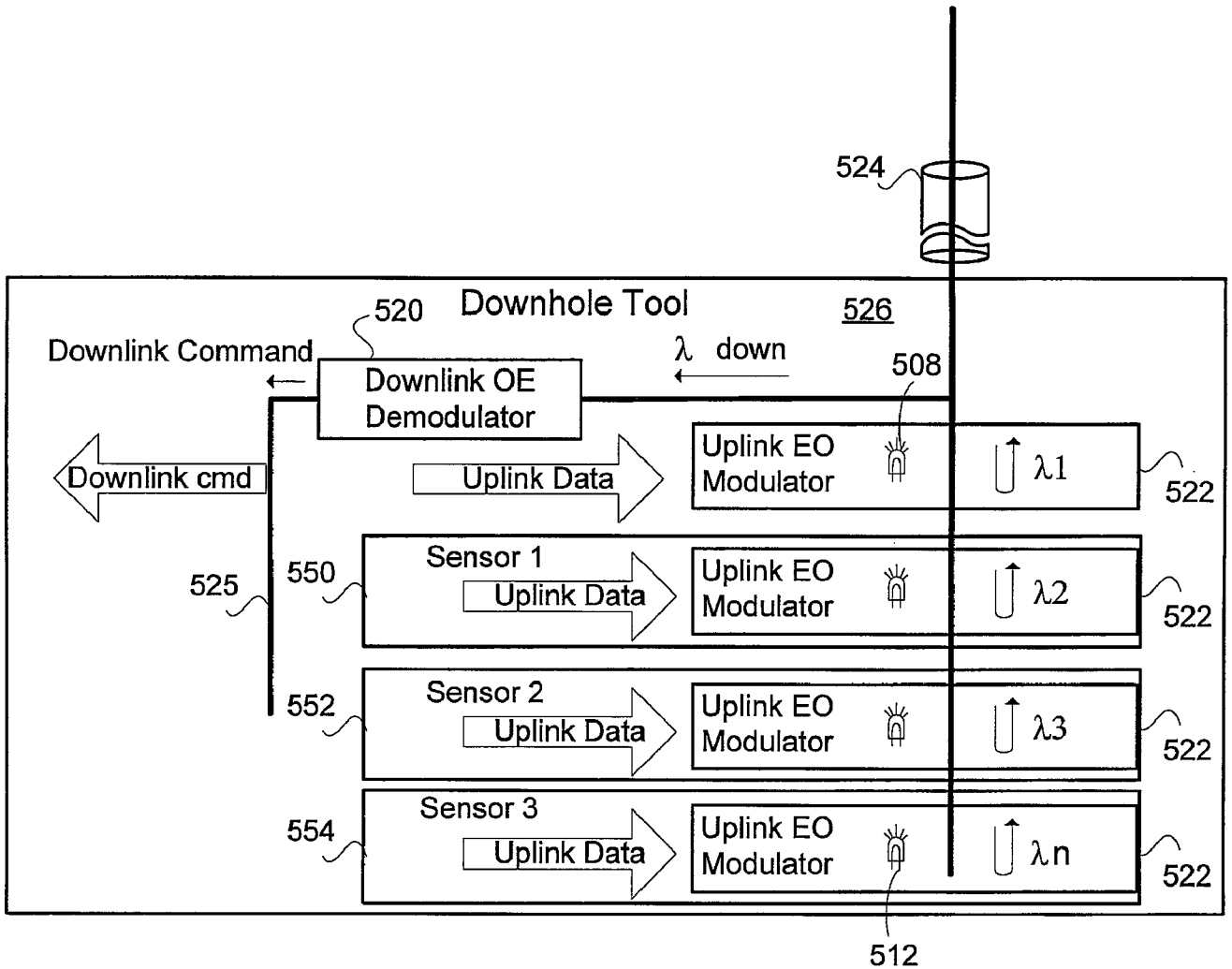
FIG. 5 is a schematic of a downhole tool having a plurality of sensors, each sensor having an optical modulator and source according to one embodiment of the present invention.

Referring next to FIG. 5, another embodiment of a downhole optical telemetry system according to the present invention is shown. The system of FIG. 5 includes a downhole tool (526) having an uplink EO modulator (522) with its own high temperature light source (508) assigned to a first wavelength (λ1) that may be directly modulated. The downhole tool (526) also includes a downlink OE demodulator (520) and a plurality of sensors (550, 552, 554). The downlink OE demodulator (520) is preferably a photo detector. Each of the plurality of sensors (550, 552, 554) has an uplink EO modulator (522) with a light source (512) assigned to a unique wavelength (λ2, λ3, λn, respectively). Therefore, the surface optical telemetry unit (104, FIG. 1) may or may not include a source. Each of the EO modulators (522) may comprise the structure of the modified lithium niobate modulator (123, FIGS. 2*a*-2*e*) described above with reference to FIGS. 2*a*-2*e*. In the event that multiple lithium niobate modulators are provided, they are operated at the same wavelength.

The downhole optical telemetry system of FIG. 5 also includes a downhole optical tool bus (524) operatively connected to the downhole tool (526) and the electrical sensors (550, 552, 554). Accordingly, the uplink EO modulators (522) modulate electrical signals from the sensors (550, 552, 554) and transmit them along the downhole optical tool bus (524) and on to the surface optical telemetry unit (104, FIG. 1).

Figure 6:
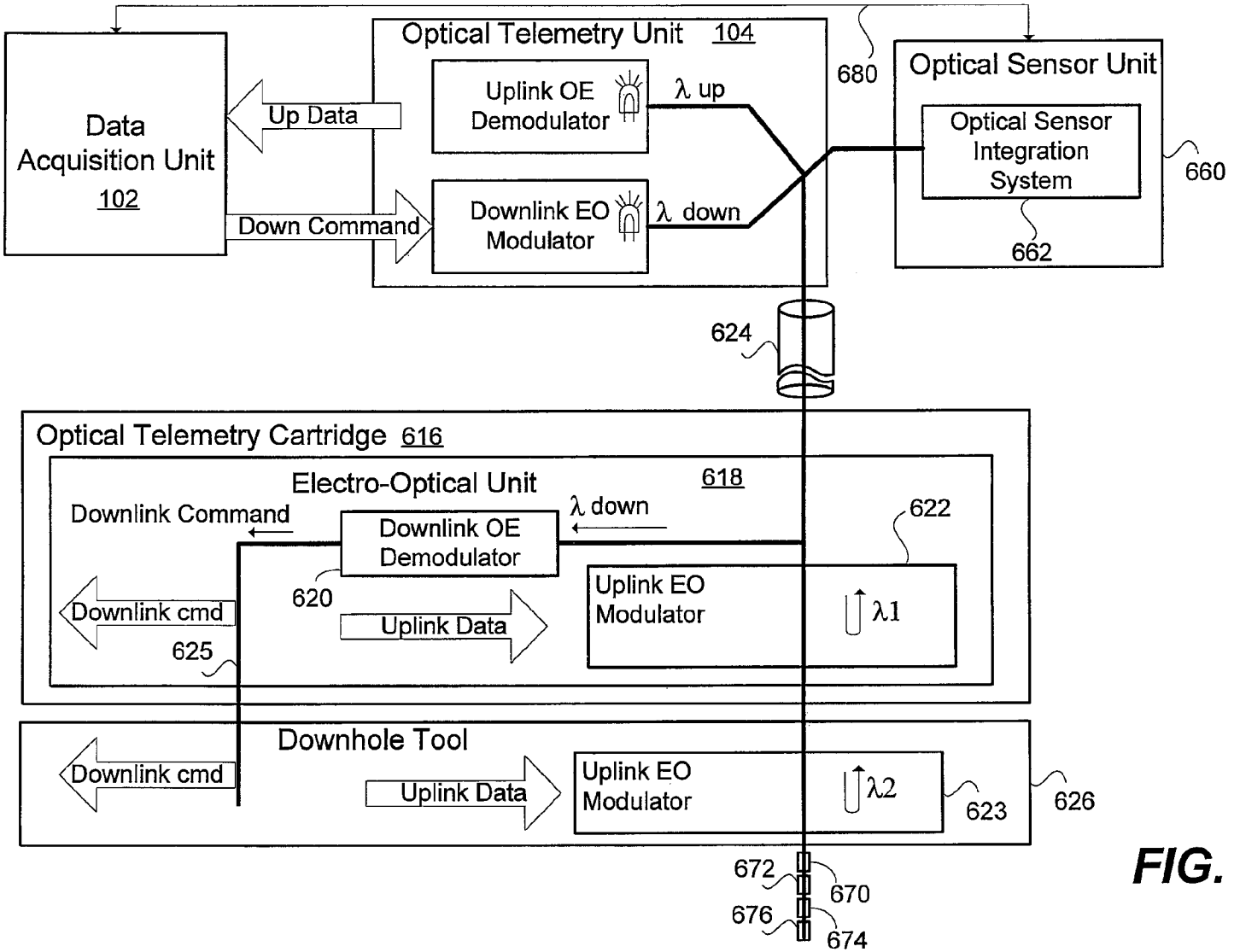
FIG. 6 is a schematic of a downhole tool having a plurality of optical sensors and coupled to an optical telemetry system according to one embodiment of the present invention.

Referring now to FIG. 6, another embodiment of a downhole optical telemetry system according to the present invention is shown. The system of FIG. 6 includes the data acquisition system (102) and surface optical telemetry unit (104) similar to that shown in FIG. 1. The system may also include a surface optical sensor unit (660) with an optical sensor integration system (662). Downhole the system includes an optical telemetry cartridge (616) comprising an electro-optical unit (618). The electro-optical unit (618) includes a firstEO modulator (622) without a source. The first EO modulator (622) is assigned to a first light wavelength (λ1), possibly using a Bragg grating or other wavelength separator. The electro-optical unit (618) also includes a downlink OE demodulator (620), which is preferably a photo detector for demodulating downlink commands. The downlink OE demodulator (620) demodulates optical signals into electrical signals and transmits them along a downhole electrical tool bus (625).

The system of FIG. 6 also includes at least one downhole tool (626) including a second EO modulator (623) similar or identical to the first EO modulator (622) but assigned to a different wavelength (λ2). The first and second EO modulators (622, 623) may comprise the structures shown and described with reference to FIGS. 2*a*-2*e*. The first and second EO modulators (622, 623) are operatively connected to a downhole optical tool bus (624) which is part of the fiber optic interface (114, FIG. 1). In addition, the downhole optical tool bus (624) is operatively connected to one or more optical fiber sensors, which according to FIG. 6 include four optical fiber sensors (670, 672, 674, 676) The optical fiber sensors (670, 672, 674, 676) may include permanent sensors in a wellbore or parts of the downhole tool (626), and may include, but are not limited to, temperature sensors, pressure sensors, and optical fluid analyzers. Signals from the optical fiber sensors (670, 672, 674, 676) are modulated and transmitted uphole via the optical tool bus (624). Use of the optical sensors (670, 672, 674, 676) may necessitate the surface optical sensor unit (660), which includes an interface (680) with the data acquisition unit (104).

Operation of the embodiment of FIG. 6 is similar to the description accompanying FIG. 1. Downlink data or commands are modulated, transmitted along the downhole optical tool bus (624), demodulated by the optical telemetry cartridge, and retransmitted to the downhole tool (626) via the electrical tool bus (625). Uplink data is modulated by one of the uplink EO modulators (622, 623) and transmitted uphole via the optical tool bus (624). The surface optical telemetry unit (104) then demodulates and retransmits the data to the data acquisition unit (102).

Figure 8:
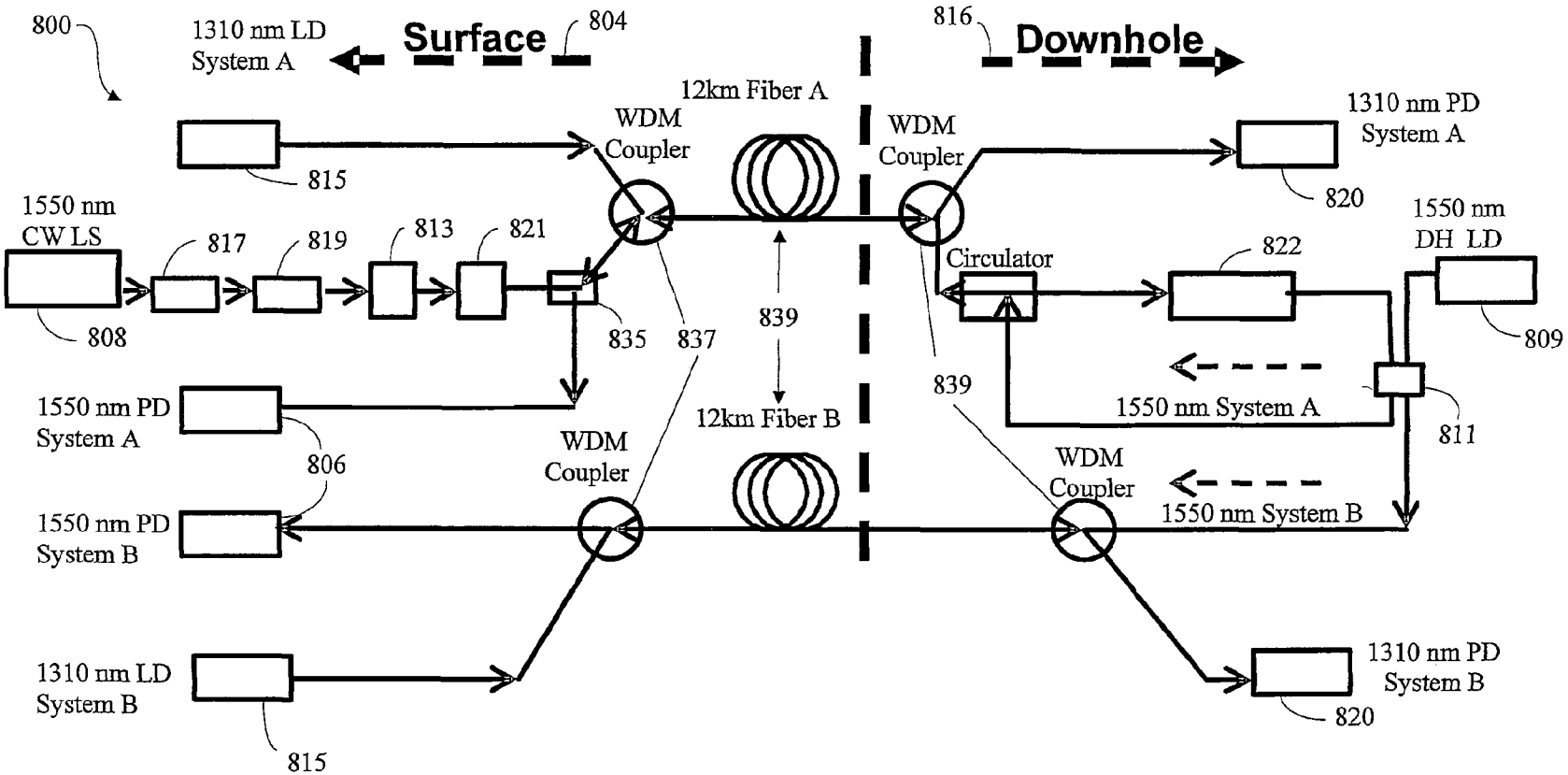
FIG. 8 is schematic of an downhole redundant optical telemetry system according to one embodiment of the present invention.

According to some aspects of the invention, an optical telemetry system may include at least two selectable modes of optical data transmission, advantageously providing a redundant optical path. For example, as shown in FIG. 8, an optical telemetry system (800) includes a surface optical telemetry unit (804) having a first optical source that may comprise a 1550 nm continuous wave (CW) light source (808) and a photo detector such as a 1550 nm photo diode (806). The surface optical telemetry unit (804) may also have a second directly modulated optical source such as a 1310 nm laser diode (815) for downlink communication. The optical telemetry system (800) also has a downhole optical telemetry unit (816) that includes an optical source such as a 1550 nm high temperature laser diode (809). The downhole optical telemetry unit (816) includes a photo detector such as a 1310 nm photo diode (820), and an external modulator such as a lithium niobate modulator (822) that may comprise the structure discussed above. An optical interface such as a 12 km fiber (814) extends between the surface optical telemetry unit (804) and the downhole optical telemetry unit (816). Along the 12 km fiber (814) is a 2×2 optical coupler (811), preferably located the downhole optical telemetry unit (816). The surface optical telemetry unit (804) and the downhole optical telemetry unit (816) are selectable between a first data transmission mode and at least a second data transmission mode. A first data transmission mode comprises use of the 1550 nm laser diode (809) to directly modulate data, which is sent uphole via the 12 km optical fiber (814) through the 2×2 coupler (811), and ultimately to the 1550 nm photo diode (806). A second data transmission mode comprises modulating light from the 1550 CW light source (808) with the lithium niobate modulator (822). The modulated light is sent uphole via the 12 km optical fiber (814) through the 2×2 coupler (811), and ultimately to the 1550 nm photo diode (806). Accordingly, if one data transmission mode fails, for example, due to a malfunction of the 1550 nm laser diode (809), the other data transmission mode may still be used. The optical telemetry system (800) may also include additional components, such as an isolator (817), inline PC (819), erbium-doped fiber amplifier (EDFA) (821), 1×2 coupler (835), and wave-division multiplexer (WDM) couplers (837) to facilitate the redundant, selectable system.

The quality of the data transmitted via the lithium niobate modulator (822) may depend on the polarization state of the input CW light from the 1550 nm CW light source (808). For a single mode fiber, the polarization state is changed rapidly by many external factors which may include fiber stress, twist, movement, bending, etc. In subterranean applications, logging cable (optical interface (814)) moves dynamically throughout the logging and measurement operation. Due to the dynamic movement of the optical logging cable, the polarization state of the light source rapidly changes and may induce substantial error to the modulated signal. As a result, the bit error rate of the transmitted signal might be poor. To compensate for the dependency on the light polarization state, an active scrambling method may be introduced. By definition, an optical active scrambler converts any polarized input light source to un-polarized output light. With an active scrambler (813) coupled to the 1550 CW light source (808), less than 5% Degree of Polarization (DOP) output light can be achieved. Accordingly, more than 95% of the output light from the active scrambler (813) is un-polarized. By sending highly un-polarized light into the lithium niobate modulator (822), the dependency of polarization state effect can be minimized and the quality of the data transmission is greatly improved.

Figure 9:
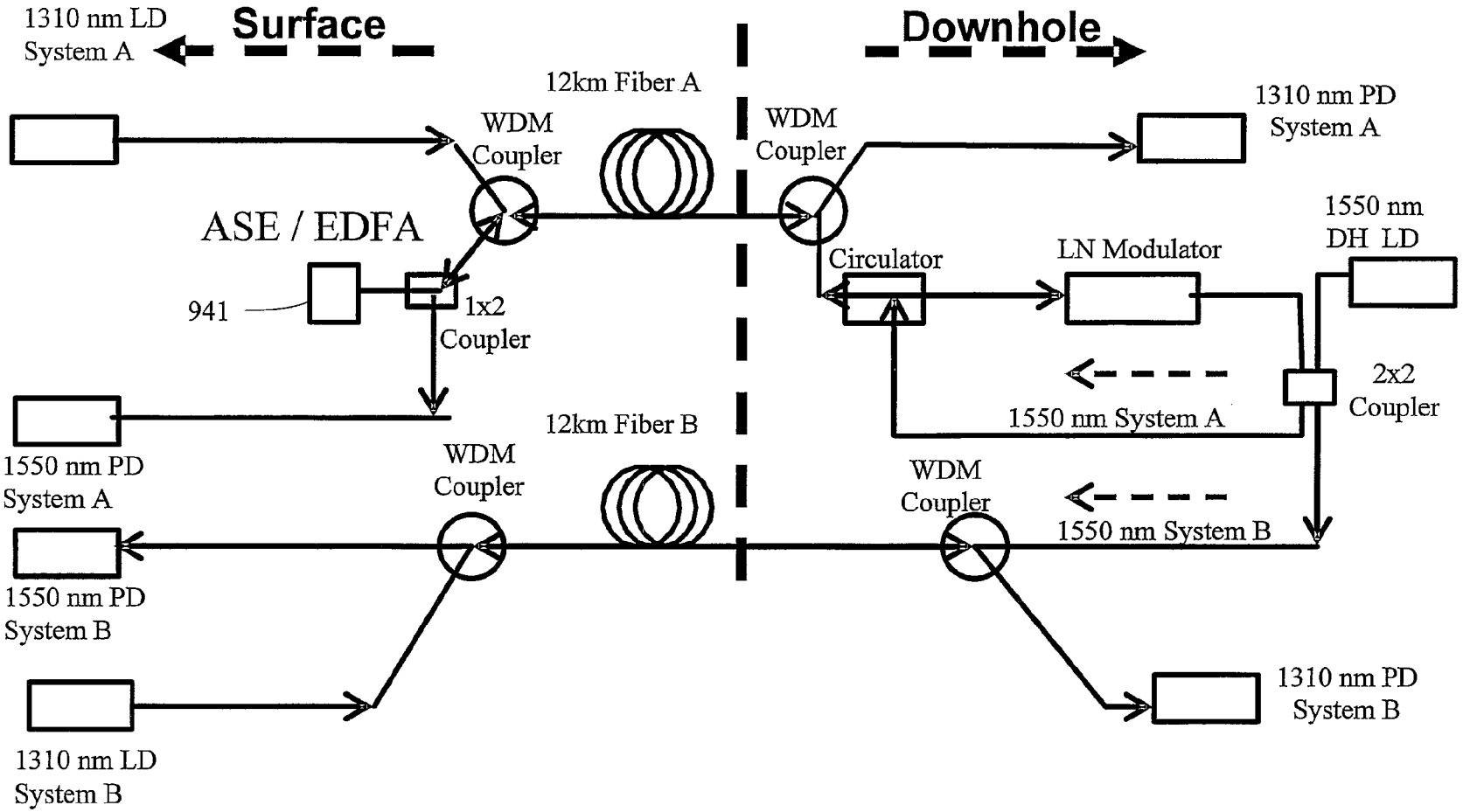
FIG. 9 is schematic of an downhole redundant optical telemetry system according to another embodiment of the present invention.

Alternatively, as illustrated in FIG. 9, optical modulator dependency on the polarization state may be reduced by using Amplified Spontaneous Emission (ASE) broadband light. Theoretically, ASE light sources can produce zero DOP broadband light. There are many ways to obtain an ASE light source (941). For example, one way is to buy a commercially available high power ASE compact light source module. Another way to produce ASE light is to power an EDFA with an input port terminated by an optical terminator. Zero DOP light completely removes modulator dependency on the polarization light state. In addition, using an ASE light source may reduce the number of optical components located at the surface, simplify the design circuitry, and reduce space and cost.

Figure 10:
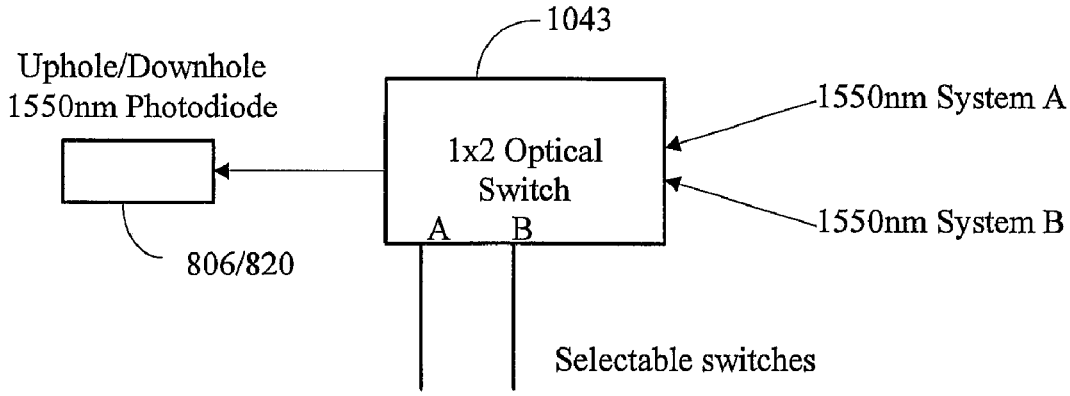
FIG. 10 is a 1×2 optical switch for use with the redundant optical telemetry systems of FIGS. 8-9 according to one embodiment of the present invention.

In order to switch between two or more different data transmission modes, the optical telemetry system (800) may include an optical switch (1043) shown in FIG. 10. The optical switch (1043) enables sharing the same photodiodes (806, 820) for each mode. The optical switch (1043) is commercially available and shifts the optical input to a desired output optical path.

Figure 11:
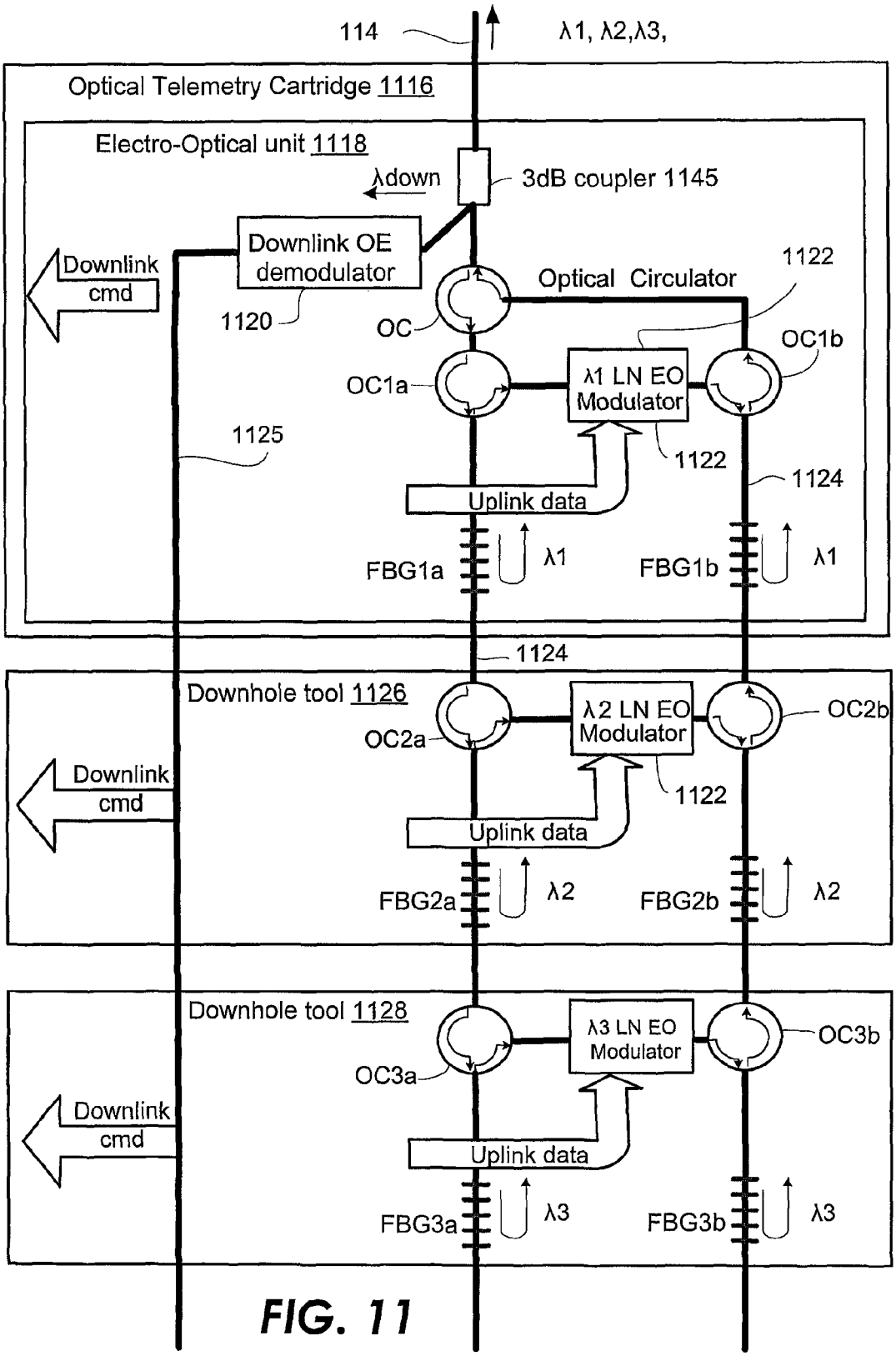
FIG. 11 is a schematic of downhole tools with an in-line optical telemetry system having an electrical tool bus for downlink, an optical tool bus for uplink, Bragg gratings for wavelength separating, and optical circulators according to another embodiment of the present invention.

Referring next to FIG. 11, another embodiment of a downhole optical telemetry system is shown. The embodiment of FIG. 11 illustrates a downhole optical tool bus (1124). The downhole optical tool bus (1124) is shown in communication with the surface optical telemetry unit (104) in FIG. 1. The embodiment of FIG. 11 includes a downhole optical telemetry cartridge (1116). The downhole optical telemetry cartridge (1116) comprises an electro-optic unit (1118). The electro-optical unit (1118) of FIG. 11 includes an uplink electrical-to-optical lithium niobate modulator (1122) and an optical separator, for example a Bragg grating, assigned to a first wavelength (λ1). The electro-optical unit (1118) also includes a downlink optical-to-electrical demodulator (1120) similar or identical to the downlink OE demodulator (120) of FIG. 1.

Further, the embodiment of FIG. 11 includes a downhole electrical tool bus (1125). The downhole electrical tool bus (1125) transmits downlink commands and provides inter-tool and/or intra-tool communication in a manner similar to that described in FIG. 1. The downhole optical tool bus (1124) comprises an extension of the fiber optic interface (114, FIG. 1). The embodiment of FIG. 11 includes one or more downhole tools (1126, 1128, each comprising an uplink electrical-to-optical modulator (1122) and a separator such as a Bragg grating assigned to a different wavelength (λ2, λ3). The uplink electrical-to-optical modulators (1122) are operatively connected to the optical tool bus (1124). Uplink data from sensors in the downhole tools (1126, 1128) may be modulated at each tool and transmitted directly to the downhole optical tool bus (1124).

To facilitate downhole optical data modulation using a surface optical source, the electro-optical unit (1118) and the downhole tools (1126, 1128) each comprise optical circulators, which include three optical circulators (OC, OC1*a*, OC1*b*) for the electro-optical unit (1118), two optical circulators (OC2*a*, OC2*b*) for the first downhole tool (1126), and two optical circulators (OC3*a*, OC3*b*) for the second downhole tool (1128). A 3 dB coupler (1145) may be located within the electro-optical unit (1118) upstream of and connected to both the downlink OE demodulator (1120) and the optical circulator (OC). Therefore, light from the surface may pass downhole through the optical circulators as indicated in FIG. 11 and be directed to one or more of the uplink electrical-to-optical modulators (1122). The light is modulated by one or more of the uplink electrical-to-optical modulators (1122) and returned uphole through the optical circulators to back to the fiber optic interface (114).

Figure 12:
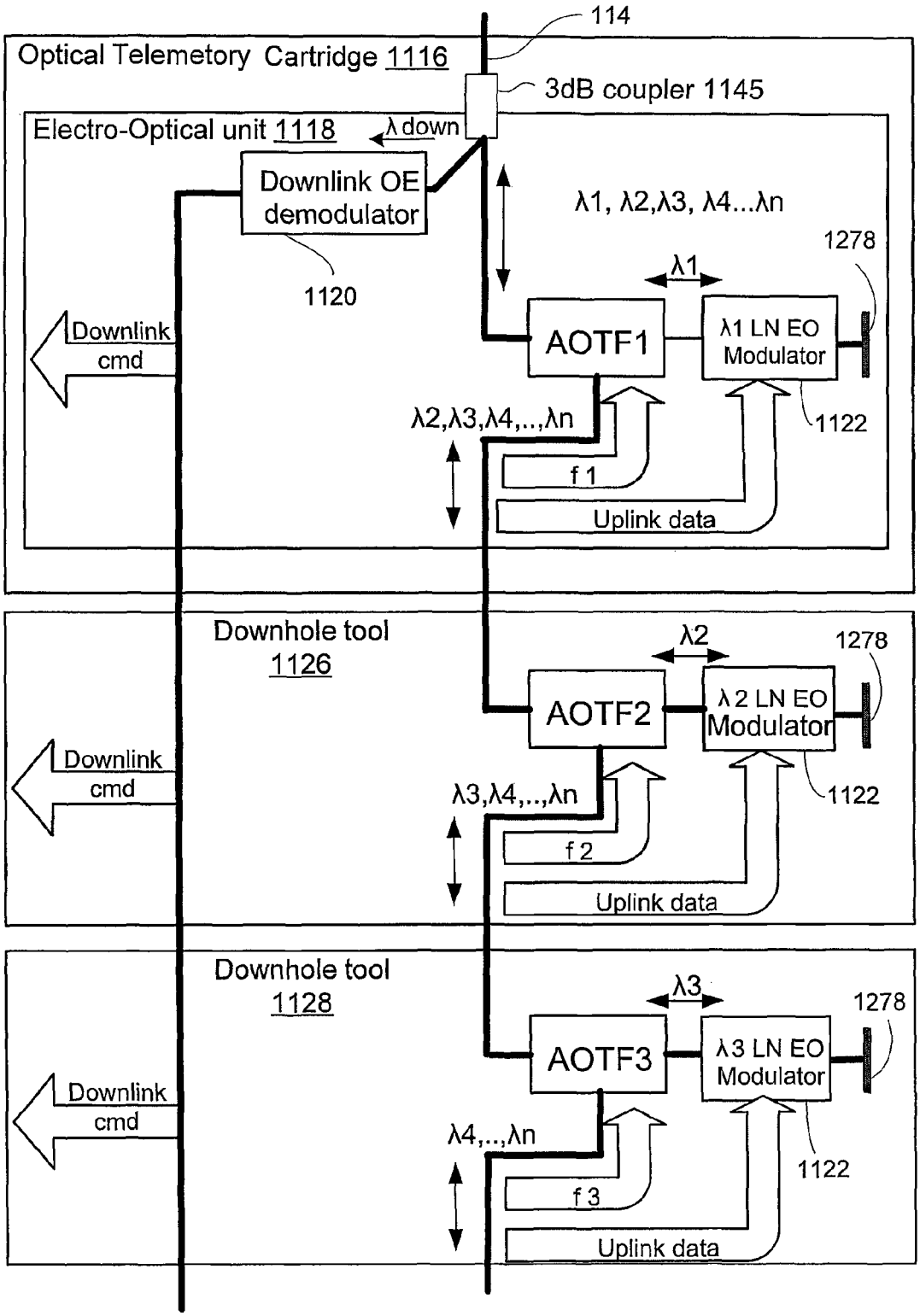
FIG. 12 is a schematic of downhole tools with an in-line optical telemetry system having an electrical tool bus for downlink, an optical tool bus for uplink, and AOTFs (acousto-optic tunable filters) for wavelength separating according to another embodiment of the present invention.

Alternative to the use of Bragg gratings to separate light wavelengths and optical circulators to direct the light as shown in FIG. 11, some systems may use AOTFs and reflectors. Accordingly, FIG. 12 illustrates replacement of the Bragg gratings with AOTFs and the use of reflectors or mirrors (1278) to redirect light received from the surface and modulated by uplink EO modulators (1122). The electro-optical unit (1118) of the optical telemetry cartridge (1116) may thus include AOTF1, and the downhole tools (1126, 1128) may include AOTF2 and AOTF3, respectively. Each of the AOTFs is tuned to a different wavelength, enabling the surface optical telemetry unit to distinguish signals from different tools.

The preceding description has been presented only to illustrate and describe the invention and some examples of its implementation. It is not intended to be exhaustive or to limit the invention to any precise form disclosed. Many modifications and variations are possible in light of the above teaching.

The preferred aspects were chosen and described in order to best explain the principles of the invention and its practical application. The preceding description is intended to enable others skilled in the art to best utilize the invention in various embodiments and aspects and with various modifications as are suited to the particular use contemplated. It is intended that the scope of the invention be defined by the following claims.

What is claimed is:

1. A method of communication between a surface location and at least one downhole tool using an electro-optical telemetry system, comprising:

generating a first light at a first light wavelength (λdown);

generating a second at a second light wavelength (λup);

modulating the first light with an uphole EO modulator to form an optical downlink data signal;

sending the optical downlink data signal to the at least one downhole tool via a single optical fiber;

converting the optical downlink data signal into an electrical data signal with a downhole OE demodulator;

obtaining a measurement of a downhole parameter with at least one sensor disposed in the at least one downhole tool;

converting an electrical signal corresponding to the measurement of the downhole parameter into an optical signal by modulating the second light with a downhole EO modulator;

sending the modulated light to the surface location via the single optical fiber; and converting the modulated light into an electrical signal at the surface location with an uphole OE demodulator.

2. The method of claim 1, further including communicating data between the at least one sensor and the downhole EO modulator using an electrical tool bus.

3. The method of claim 2, further including providing a plurality of sensors in two or more tools in a wellbore and communicating data between the plurality of sensors in the two or more tools using the electrical tool bus.

4. The method of claim 1, wherein downhole EO modulator includes a light source.

5. The method of claim 1, wherein a light source for the first light wavelength and the second light wavelength is located at the surface location.

6. The method of claim 1, wherein a light source for the first light wavelength is provided proximate to one end of the single optical fiber and a light source for the second light wavelength is provided proximate to another end of the single optical fiber.

7. A method of communication between a surface location and at least one downhole tool using an electro-optical telemetry system, comprising:

sending an electrical signal to a surface EO modulator;

converting the electrical signal into an optical signal;

sending the optical signal to a downhole tool via a single optical fiber at a first light wavelength (λdown);

converting the optical signal into an electrical signal;

sending the electrical signal to at least one tool via an electrical tool bus;

obtaining a measurement of a downhole parameter with a sensor disposed in a wellbore;

converting an electrical signal corresponding to the measurement of the downhole parameter into an sensor optical signal with a downhole EO modulator;

sending the sensor optical signal to the surface location via the single optical fiber at a second light wavelength (λ up); and converting the sensor optical signal into a sensor electrical signal at the surface location with an uphole OE modulator.

8. A method of communication between a surface location and at least one downhole tool using an electro-optical telemetry system, comprising:

generating an optical signal at the surface location;

sending the optical signal to a downhole tool via a single optical fiber at a first light wavelength (λ down);

converting the optical signal into an electrical signal via a downhole OE modulator;

sending the electrical signal to at least one tool via an electrical tool bus;

obtaining a measurement of a downhole parameter with a sensor disposed in the at least one tool;

converting an electrical signal corresponding to the measurement of the downhole parameter into an optical signal by modulating the optical signal sent from the surface location with a downhole EO modulator;

sending the modulated optical signal to the surface location via the single optical fiber at a second light wavelength (λ up); and converting the modulated optical signal into an electrical signal at the surface location with an uphole OE modulator.

9. The method of claim 8, wherein the at least one tool comprises a plurality of tools.

10. The method of claim 8, wherein the sensor comprises a plurality of sensors.

11. The method of claim 8, wherein the downhole EO modulator comprises a light source.

* * * * *